United States Patent [19]

Sugimoto et al.

[11] Patent Number: 5,009,843

[45] Date of Patent: Apr. 23, 1991

[54] SPRING STEEL HAVING GOOD DURABILITY AND SAG-RESISTANCE

[75] Inventors: Atsushi Sugimoto; Osamu Nakano; Shigeru Yasuda; Chikatoshi Maeda; Toshio Ozone; Makoto Kawagoe, all of Aichi, Japan

[73] Assignees: Aichi Steel Works, Ltd., Tokai; Toyota Jidosha Kabushiki Kaisha, Toyota; Chuo Hatsujo Kabushiki Kaisha, Nagoya, all of Japan

[21] Appl. No.: 526,893

[22] Filed: May 22, 1990

[30] Foreign Application Priority Data

May 29, 1989 [JP] Japan ..... 1-135631

[51] Int. Cl.[5] ..... C22C 38/40

[52] U.S. Cl. ..... 420/112; 420/108; 420/109; 148/908

[58] Field of Search ..... 420/108, 105, 109, 117, 420/110, 112, 111; 148/908, 335, 333, 334; 29/173

[56] References Cited

U.S. PATENT DOCUMENTS

| | | | |
|---|---|---|---|
| 3,431,101 | 3/1969 | Kunitake et al. | 420/111 |
| 4,448,617 | 5/1984 | Yamamoto et al. . | |
| 4,650,645 | 3/1987 | Kato et al. | 420/108 |
| 4,795,609 | 1/1989 | Solca | 148/908 |

FOREIGN PATENT DOCUMENTS

| | | | |
|---|---|---|---|
| 0232061 | 8/1987 | European Pat. Off. . | |
| 0265273 | 4/1988 | European Pat. Off. . | |
| 350111 | 3/1922 | Fed. Rep. of Germany . | |
| 58-67847 | 4/1983 | Japan | 148/908 |
| 59-170241 | 9/1984 | Japan | 148/908 |
| 38419 | 4/1988 | Japan . | |
| 973659 | 11/1982 | U.S.S.R. | 148/908 |
| 766090 | 1/1957 | United Kingdom . | |
| 1142236 | 2/1969 | United Kingdom . | |
| 1179074 | 1/1970 | United Kingdom . | |

OTHER PUBLICATIONS

*Metal Material Data Book* (Steels for special purposes), 1985, Japanese Standards Association, pp. 212–215.

*Primary Examiner*—Deborah Yee

*Attorney, Agent, or Firm*—Oblon, Spivak, McClelland, Maier & Neustadt

[57] ABSTRACT

A spring steel having a good durability and a good sag-resistance consisting essentially of by weight 0.35–0.55% carbon, 1.80–3.00% silicon, 0.50–1.50% manganese, 0.50–3.00% nickel, 0.10–1.50% chromium, 0.01–0.05% aluminum and 0.010–0.025% nitrogen, the remainder being iron and inevitable impurities.

The spring steel has been completed for the purpose of obtaining a spring steel having a high toughness in a high hardness of not less than HRC 55 and having a good sag-resistance, in particular examining the contents of nickel, chromium and nitrogen in addition to the carbon content.

4 Claims, No Drawings

SPRING STEEL HAVING GOOD DURABILITY AND SAG-RESISTANCE

BACKGROUND OF THE INVENTION

1. Field of the Invention:

The present invention relates to a spring steel having a good durability and a good sag-resistance.

2. Description of the Related Art

There has been an increasing demand for light weight suspension coil springs reflecting a trend toward light weight parts in transportation such as automobiles in order to save energy and realize high performance, in recent years.

An effective approach to the reduction of weight is to design the springs to have an increased stress, in other words, to increase a designed stress. Designed stress referred to here is defined as a stress required of the springs in design. However, if conventional spring steels are used to produce coil springs for vehicles, having an increased designed stress, there will be problems such that the level of the springs will be lowered as time passes (it is so-called sag), accordingly the height of the vehicle will significantly be decreased, and consequently the location of the bumper will be lowered thus leading to a serious problems for safety. Accordingly, it has been impossible to increase a designed stress in the springs.

In the use of the springs, a pulsating load is repeatedly applied thereto. When the designed stress is increased, the springs would be broken in the early stage.

In view of the abovementioned problem, it has been strongly desired to develop a spring steel which is excellent in both a sag-resistance and a durability.

As a conventional coil spring, JIS SUP6 had been used. However, it has become evident that Si is effective in sag-resistance, JIS SUP7 has broadly been used. A spring steel containing at least one of vanadium and niobium, in JIS SUP7 has been developed and is used at present, as a spring steel which is excellent in a sag-resistance and capable of weight reduction.

However, there is a stronger demand for light weight automobiles, so it is desired to develop spring steels having a performance superior to that of the aforesaid spring steel containing vanadium and/or niobium in JIS SUP7, and having more excellent sag-resistance and durability which enable the use under a higher stress state.

In a conventional spring steel, a method to increase the hardness of a spring has been used for the purpose of using it under a high stress state. Though this method can improve the sag-resistance, deterioration of the durability due to toughness deterioration was inevitable. The deterioration of the toughness causes increase of notch sensitivity. Accordingly, a brittleness breaking which starts from an inclusion or flaw which exists inside a material, easily occurs by repeated stresses lower than a allowable stress. The durability of a spring is significantly reduced. Under the circumstances, there is a stronger demand for a spring steel which makes high stress designing possible.

SUMMARY OF THE INVENTION

The object of the present invention is to provide a spring steel having a good durability and a good sag-resistance, which ensures a high toughness in spite of a high hardeness over the aforesaid problems in conventional arts. Thus, the present invention provides a spring steel having a good durability and a good sag-resistance, consisting essentially of by weight 0.35–0.55% carbon, 1.80–3.00% silicon, 0.50–1.50% manganese, 0.50–3.00% nickel, 0.10–1.50% chromium, 0.01–0.05% aluminum and 0.010–0.025% nitrogen, the remainder being iron and inevitable impurities, as the first aspect.

DETAILED DESCRIPTION OF THE INVENTION

It should particularly be noted in the present invention that carbon is contained in the lower amount, nickel and chromium are further added, and nitrogen is contained in the greater amount, in comparison with the conventional arts.

Carbon is essential to provide a sufficient strength required for use as a spring steel. In a conventional steel, 0.6% of carbon has been added. However, in recent years, a spring steel is required to have a spring hardness of not less than HRC 55 for the purpose of providing a higher stress with a suspension spring. It is required to have a higher toughness than that of the conventional steel in view of such problem as increase of notch sensitivity as the spring is used in higher hardenability.

Carbon increases a strength of the spring steel but reduces a toughness. So, in the present invention, the content of carbon is restricted within a range as low as possible, which ensures a necessary strength, and a high toughness.

The spring steel according to the present invention has been completed for the purpose of obtaining a spring steel having a high toughness in a high hardness of not less than HRC 55 and having a good sag-resistance, in particular examining the contents of nickel, chromium and nitrogen in addition to the aforesaid carbon content.

Nickel is added so as to strengthen the spring steel because the toughness cannot sufficiently improved only by reducing the carbon content as abovementioned. The spring steel according to the present invention is a spring steel of high silicon content, and the silicon content is so large that decarbonization easily occurs. Accordingly, chromium is added so as to control the decarbonization.

Nitrogen should be comprised in the spring steel so as to improve a sag-resistance by reacting with aluminum in the steel to produce AlN and precipitate it as fine nitride particles.

In the second aspect of the invention, at least one selected from a group consisting of 0.05–0.50 wt % vanadium, 0.05–0.50 wt % niobium and 0.05–0.50 wt % molybdenum is incorporated with the spring steel of the first aspect in order to obtain better durability and sag-resistance.

In the third aspect of the invention, the oxygen content is limited to not more than 0.0015 wt % so as to improve the durability more than that of the steel of the first aspect.

In the fourth aspect of the invention, at least one selected from a group consisting of 0.05–0.50 wt % vanadium, 0.05–0.50 wt % niobium and 0.05–0.50 wt % molybdenum, and not more than 0.0015 wt % oxygen are incorporated with the spring steel of the first aspect in order to obtain particularly better durability and sag-resistance.

The following is the reason why the amount of each element is specified as mentioned above.

The carbon content should be 0.35–0.55% by weight. When the carbon amount is less than 0.35%, a sufficient strength required for use as a high-stress spring steel cannot be obtained by quenching and tempering. When the carbon amount exceeds 0.55%, it leads to a decrease in toughness, and the steel may be broken in water quencning.

The silicon content should be 1.80–3.00% by weight. Silicon has an effect to improve a sag-resistance and a tempering property. When the amount is less than 1.80%, a sufficient effect cannot be expected. However when the amount exceeds 3.00%, excess silicon does not produce any effect to improve a sag-resistance in proportion to the excess amount, and decarbonization becomes significant in rolling and heat treatment of the spring steel.

The manganese content should be 0.50–1.50% by weight. At least 0.50% manganese is necessary to cause martensite transformation sufficiently to the core of the spring steel in hardening. However, when the amount exceeds 1.50%, the toughness significantly decreases.

The nickel content should be 0.50–3.00% by weight. Nickel is incorporated with the spring steel in order to improve a toughness. When the amount is less than 0.50%, the effect is insufficient. When the amount exceeds 3.0%, excess nickel does not produce any effect to improve toughness in proportion to the excess amount, martensite transformation is not sufficiently conducted in hardening and a large amount of retained austenite may be produced.

The chromium content should be 0.10–1.50% by weight. Chromium has an effect to improve hardenability. Decarbonization easily occurs in the spring steel of the present invention due to high content of silicon, and chromium has an effect to depress the decarbonization. However, when the amount is less than 0.10%, the effect is insufficient, whereas when the amount exceeds 1.50%, the tempered structure of the steel becomes uneven and it may impair a sag-resistance.

The aluminum content should be 0.01–0.05% by weight. Aluminum is combined with nitrogen to form AlN. In the aforesaid range of the aluminum content, the grain size of AlN is made fine. Thus, a sag-resistance and a durability are improved. However, when the amount is less than 0.01%, the aforesaid AlN cannot sufficiently be fined. When the amount exceeds 0.05%, a AlN particle of great dimensions is easily produced and it affects the steel as an inside fault to reduce a fatigue strength.

The nitrogen content should be 0.010–0.025% by weight. Nitrogen reacts with aluminum to form AlN. In the aforesaid range of the nitrogen content, the grain size of AlN is made fine so that a sag-resistance and a durability are improved. When the amount is less than 0.010%, the aforesaid effect cannot sufficiently be expected, whereas when the amount exceeds 0.025%, $N_2$ gas is produced within the steel in the process of cooling in casting and it leads a internal fault in the steel.

The vanadium, niobium and molybdenum contents should be 0.05–0.50% by weight respectively. Vanadium, niobium and molybdenum have an effect to make the grain size fine and improve a sag-resistance and a durability. However, the amount of at least one selected from the aforesaid elements is less than 0.05%, the satisfactory effect cannot be displayed. When the amount exceeds 0.50%, a carbide of great dimensions is produced to reduce a fatigue strength.

The oxygen content should be not more than 0.0015% by weight. Oxygen may produce an oxide inclusion such as $Al_2O_3$ from which fatigue fracture starts. Accordingly, the upper limit is set to be not more than 0.0015%.

In the present invention, it should particularly be noted that the carbon content is reduced, nickel and chromium are contained in addition to the elements of a conventional steel, and a larger amount of nitrogen than that of the conventional steel is contained. Further, at least one of vanadium, niobium and molybdenum are incorporated with the steel, if necessary. The oxygen content is limited.

According to the present invention, there can be provided with a spring steel having a good durability and a good sag-resistance compared with those of a conventional spring steel of high silicon content.

EXAMPLE

The invention will be described with reference to the following examples in comparison with a conventional steel and comparative steels. Each of the steels are shown in Table 1.

TABLE 1

| | Chemical compositions (% by weight) | | | | | | | | | | | |
|---|---|---|---|---|---|---|---|---|---|---|---|---|
| | C | Si | Mn | Ni | Cr | Al | N | V | Nb | Mo | O | |
| A | 0.43 | 2.48 | 1.26 | 1.00 | 0.15 | 0.01 | 0.015 | | | | | First |
| B | 0.45 | 2.25 | 0.95 | 1.23 | 0.43 | 0.02 | 0.013 | | | | | aspect |
| C | 0.46 | 2.36 | 1.01 | 1.10 | 0.31 | 0.01 | 0.017 | | | | | |
| D | 0.38 | 2.67 | 1.19 | 2.01 | 0.70 | 0.03 | 0.022 | | | | | |
| E | 0.47 | 2.58 | 0.68 | 1.43 | 1.41 | 0.02 | 0.011 | 0.08 | | | | Second |
| F | 0.45 | 2.83 | 1.41 | 0.65 | 0.39 | 0.03 | 0.015 | 0.22 | 0.09 | | | aspect |
| G | 0.52 | 2.48 | 1.30 | 2.56 | 0.22 | 0.02 | 0.012 | 0.37 | 0.11 | 0.35 | | |
| H | 0.42 | 1.95 | 1.28 | 1.85 | 0.25 | 0.04 | 0.018 | | 0.37 | | | |
| I | 0.44 | 2.33 | 1.01 | 0.95 | 0.33 | 0.02 | 0.013 | | 0.13 | 0.38 | | |
| J | 0.41 | 2.49 | 1.25 | 1.01 | 0.20 | 0.03 | 0.016 | 0.43 | | 0.22 | | |
| K | 0.48 | 2.11 | 0.85 | 1.57 | 0.55 | 0.02 | 0.014 | | | 0.20 | | |
| L | 0.42 | 2.52 | 1.33 | 0.85 | 0.23 | 0.02 | 0.012 | | | | 0.0010 | 3rd aspect |
| M | 0.46 | 2.47 | 1.18 | 0.99 | 0.23 | 0.03 | 0.014 | 0.40 | | 0.25 | 0.0012 | 4th aspect |
| N | 0.31 | 2.05 | 1.24 | 1.34 | 0.42 | 0.02 | 0.016 | | | | | Comparative |
| O | 0.62 | 2.21 | 0.89 | 1.05 | 0.37 | 0.03 | 0.018 | | | | | steel |
| P | 0.44 | 2.03 | 1.03 | 0.33 | 0.45 | 0.03 | 0.013 | | | | | |
| Q | 0.48 | 2.41 | 1.10 | 1.21 | 0.35 | 0.02 | 0.008 | | | | | |
| R | 0.39 | 2.33 | 1.20 | 1.88 | 0.51 | 0.03 | 0.030 | | | | | |
| S | 0.60 | 2.01 | 0.85 | 0.05 | 0.17 | 0.02 | 0.008 | | | | | Conventional |
| T | 0.59 | 2.03 | 0.89 | 0.05 | 0.16 | 0.02 | 0.008 | 0.14 | 0.09 | | | steel |

In Table 1, samples A to D represent the steels pertaining to the first aspect of the present invention; samples E to K represent the steels pertaining to the second aspect of the present invention; sample L represents the steel pertaining to the third aspect of the present invention; sample M represents the steel pertaining to the fourth aspect of the present invention; samples N to R represent the steels in comparative examples; and samples S and T represent the steels of conventional type. Sample S is composed of JIS SUP7. Sample T is produced by incorporating niobium and vanadium with JIS SUP7.

In Table 2, the results of Charpy impact test in respect of the sample steels in Table 1 were shown. The test was carried out in the following manner. Each of the aforesaid sample steels was extended into a bar 20 mm in diameter to form a V-notched test piece conforming to JIS No. 3 for Charpy impact test. Then, the test piece was subjected to quenching and tempering treatments to bring the final hardness to be HRC 55. The test was conducted at room temperature.

As is apparent from Table 2, samples A to M according to the present invention show higher impact values in a hardness of HRC 55 in comparison with the conventional steels, samples S and T. Regarding samples O and R which contain a larger amount of carbon and nitrogen, respectively, compared with the steels of the present invention, the impact values are low.

In Table 3, the results of torsional creep test were shown to evaluate the sag-resistance in respect of samples A to T. The torsional creep test was carried out in the following manner. Each of the aforesaid sample steels was extended into a bar 20 mm in diameter next to prepare a test piece having a diameter of 8.5 mm at the parallel portions. The thus prepared test piece was subjected to quenching and tempering treatments to bring the final hardness to be HRC 55.

Then, after subjected to setting, a tortional torque to give a shear stress 130 kgf/mm$^2$ in a surface of the parallel portions was exerted to the test pieces, and after the expiration of 24 hours, the creep strain of the test pieces was measured for evaluation.

The experiment was conducted in an air-conditioned room at a constant temperature of 25° C. to avoid increase or decrease of sagging depending on a temperature change. In view of the fact that a tortional torque is exerted to a coil spring in use and sagging is considered to be a kind of creep, a sag-resistance of a material for coil springs can be evaluated based on these test results.

As is apparent from Table 3, samples A to M according to the present invention exhibit a sag-resistance superior to that of samples S and T as the conventional steels. Particularly it is acknowleged that samples I to K and M containing vanadium, niobium and /or molybdenum have an excellent sag-resistance.

For the purpose of confirming the effectiveness when the steel of the present invention is really formed to a spring, coil springs having the characteristics shown in Table 4, were prepared using the representative seven steels of the above sample steels of the present invention as the base materials, and subjected to quenching and tempering treatments to bring the final hardness to be HRC 55. Then, they were subjected to shot peening, hot setting, etc, thereby to obtain specimens for sagging tests. These specimens were brought under a load sufficient to give a shear stress of bars to be 130 kgf/mm$^2$, and after the expiration of 96 hours, the sagging of the coil springs was measured.

The test was conducted at constant temperature of 80° C. In order to determine the sagging, a load $P_1$ required to compress the coil springs to a predetermined level prior to the sagging test and a load $P_2$ required to compress them to the same level after the sagging test, were measured, and the sagging was calculated by applying the difference $P(P_1-P_2)$ to the following equation, and sagging was evaluated by values having a unit of shear strain and referred to as residual shear strain.

$$\Gamma R = \frac{1}{G} \cdot K \frac{8D}{\pi d^3} \Delta P$$

ΓR: Residual shear strain
G: Shear modulus (kgf/mm$^2$)
D: Average coil diameter (mm)
d: Bar diameter (mm)
K: Wahl's coefficient (A coefficient depending upon the shape of a coil spring)

The test results are shown in Table 5. As is apparent from Table 5, A, G, J, L and M steels of the present invention are significantly superior in the sagging to S and T steels as the conventional steels.

Using the representative twelve steels of the above sample steels including the conventional steels, the comparative steels and the steels of the present invention, coil springs having the characteristics shown in Table 4 were prepared, and subjected to shot peening. A load to give an average stress of 85 kgf/mm$^2$ and a stress amplitude of 45 kgf/mm$^2$ were repeatedly exerted for fatigue tests. The test results are shown in Table 6.

As is apparent from Table 6, A, G, J, L and M steels of the present invention are significantly superior in the durability even in the hardness of HRC 55 to S and T steels as the conventional steels. Upon the repetition of the loading for 200,000 times, no breakage was observed in any one of the coil springs.

TABLE 2

| | Impact value (kg f m/cm$^2$) | | Impact value (kg f m/cm$^2$) |
|---|---|---|---|
| A | 5.43 | K | 4.99 |
| B | 5.26 | L | 5.48 |
| C | 5.41 | M | 5.33 |
| D | 5.67 | N | 6.22 |
| E | 4.72 | O | 2.63 |
| F | 5.01 | P | 4.16 |
| G | 4.45 | Q | 5.20 |
| H | 5.33 | R | 2.89 |
| I | 5.07 | S | 2.56 |
| J | 5.47 | T | 3.01 |

TABLE 3

| | Torsional creep strain after 24 HR ($\times 10^{-6}$) | | |
|---|---|---|---|
| A | 1540 | K | 1380 |
| B | 1507 | L | 1527 |
| C | 1518 | M | 1277 |
| D | 1531 | N | 1801 |
| E | 1371 | O | 1570 |
| F | 1304 | P | 1562 |
| G | 1189 | Q | 1637 |
| H | 1402 | R | 1551 |
| I | 1290 | S | 1823 |
| J | 1254 | T | 1601 |

TABLE 4

| Characteristics of coil springs | |
|---|---|
| Bar diameter (mm) | 13.5 |
| Bar length (mm) | 2470 |
| Average coil (mm) diameter | 120 |
| Number of turns | 6.75 |
| Effective number of turns | 4.75 |
| Spring rate (kgf/mm$^2$) | 4.05 |

TABLE 5

| Residual shear strain ($\times 10^{-4}$) | | | |
|---|---|---|---|
| A | 5.2 | M | 4.4 |
| G | 3.5 | S | 10.3 |
| J | 4.2 | T | 8.1 |
| L | 4.8 | | |

TABLE 6

| Number of repetition | | | |
|---|---|---|---|
| A | $2 \times 10^5$ not broken | O | $1.5 \times 10^5$ |
| G | $2 \times 10^5$ not broken | P | $1 \times 10^5$ |
| J | $2 \times 10^5$ not broken | Q | $2 \times 10^5$ not broken |
| L | $2 \times 10^5$ not broken | R | $1 \times 10^5$ |
| M | $2 \times 10^5$ not broken | S | $7 \times 10^4$ |
| N | $8 \times 10^5$ not broken | T | $9 \times 10^4$ |

As described hereinabove, the present invention is successful in obtaining a spring steel having a good durability and a good sag-resistance by reducing the carbon content, adding proper amounts of nickel, chromium and nitrogen, incorporating vanadium, niobium and molybdenum therewith alone or in a combination and reducing the oxygen content.

The present invention is extremely useful to develop a vehicle suspension spring having an increased stress and is highly practical.

What is claimed is:

1. A spring steel having a good durability and a good sag-resistance consisting essentially of by weight 0.35–0.55% carbon, 1.80–3.00% silicon, 0.50–1.50% manganese, 0.50–3.00% nickel, 0.10–1.50% chromium, 0.01–0.05% aluminum and 0.010–0.025% nitrogen, the remainder being iron and inevitable impurities.

2. A spring steel having a good durability and a good sag-resistance consisting essentially of by weight 0.35–0.55% carbon, 1.80–3.00% silicon, 0.50–1.50% manganese, 0.50–3.00% nickel, 0.10–1.50% chromium, 0.01–0.05% aluminum, 0.010–0.025% nitrogen, and at least one selected from a group consisting of 0.05–0.50% vanadium, 0.05–0.50% niobium and 0.05–0.50% molybdenum, the remainder being iron and inevitable impurities.

3. A spring steel having a good durability and a good sag-resistance consisting essentially of by weight 0.35–0.55% carbon, 1.80–3.00% silicon, 0.50–1.50% manganese, 0.50–3.00% nickel, 0.10–1.50% chromium, 0.01–0.05% aluminum, 0.010–0.025% nitrogen and not more than 0.0015% oxygen, the remainder being iron and inevitable impurities.

4. A spring steel having a good durability and a good sag-resistance consisting essentially of by weight 0.35–0.55% carbon, 1.80–3.00% silicon, 0.50–1.50% manganese, 0.50–3.00% nickel, 0.10–1.50% chromium, 0.01–0.05% aluminum, 0.010–0.025% nitrogen, at least one selected from a group consisting of 0.05–0.50% vanadium, 0.05–0.50% niobium and 0.05–0.50% molybdenum and not more than 0.0015% oxygen, the remainder being iron and inevitable impurities.

* * * * *

UNITED STATES PATENT AND TRADEMARK OFFICE

CERTIFICATE OF CORRECTION

PATENT NO. : 5,009,843

DATED : April 23, 1991

INVENTOR(S) : Atsushi Sugimoto et al

It is certified that error appears in the above-indentified patent and that said Letters Patent is hereby corrected as shown below:

Column 1, line 26, before "serious", delete "a";
line 67, delete "hardeness", insert --hardness--.

Column 2, line 39, after "cannot", insert --be--.

Column 3, line 7, delete "quencning", insert --quenching--.

Column 4, line 14, delete "a", insert --an--;
line 18, after "However,", insert --when--.

Column 5, line 39, delete "tortional", insert --torsional--;
line 47, delete "tortional", insert --torsional--.

Column 7, line 32, delete "8 X $10^5$", insert --8 X $10^4$--, and delete "not broken".

Signed and Sealed this

Twenty-fourth Day of August, 1993

Bruce Lehman

*Attest:*

BRUCE LEHMAN

*Attesting Officer*

*Commissioner of Patents and Trademarks*